US010923063B2

(12) United States Patent
Zhang et al.

(10) Patent No.: US 10,923,063 B2
(45) Date of Patent: Feb. 16, 2021

(54) GATE DRIVING CIRCUIT AND DRIVING METHOD, ARRAY SUBSTRATE, AND DISPLAY DEVICE

(71) Applicants: Fuzhou BOE Optoelectronics Technology Co., Ltd., Fujian (CN); BOE TECHNOLOGY GROUP CO., LTD., Beijing (CN)

(72) Inventors: Honglin Zhang, Beijing (CN); Baoqiang Wang, Beijing (CN); Jinbo Tang, Beijing (CN)

(73) Assignees: Fuzhou BOE Optoelectronics Technology Co., Ltd., Fuzhou (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/428,019

(22) Filed: May 31, 2019

(65) Prior Publication Data

US 2020/0105217 A1 Apr. 2, 2020

(30) Foreign Application Priority Data

Sep. 27, 2018 (CN) ..... 201811132950.4

(51) Int. Cl.
*G09G 3/36* (2006.01)

(52) U.S. Cl.
CPC ..... *G09G 3/3677* (2013.01); *G09G 3/3614* (2013.01); *G09G 3/3688* (2013.01); *G09G 2310/0286* (2013.01); *G09G 2310/08* (2013.01)

(58) Field of Classification Search
None
See application file for complete search history.

(56) References Cited

U.S. PATENT DOCUMENTS

2006/0001638 A1* 1/2006 Jeon ..... G09G 3/3677 345/100
2009/0278782 A1* 11/2009 Chen ..... G09G 3/3677 345/100
2010/0194716 A1* 8/2010 Park ..... G09G 3/3233 345/204
2011/0007040 A1* 1/2011 John ..... G09G 3/20 345/204
2015/0310815 A1* 10/2015 Deng ..... G09G 3/3614 345/209

* cited by examiner

*Primary Examiner* — Dorothy Harris
(74) *Attorney, Agent, or Firm* — Thomas|Horstemeyer, LLP

(57) ABSTRACT

A gate driving circuit includes 4n stages of shift register units, and n stages of inversion units. One of the inversion units is disposed between every two groups of four adjacent stages of shift register units. A (n+1)th stage of the inversion units is disposed between two of the shift register units, and configured to output in inverted phases gate driving signals outputted by the two shift register units in a heavy-load screen stage, and output in positive phases gate driving signals outputted by the two shift register units in a normal screen stage.

13 Claims, 7 Drawing Sheets

GATE DRIVING CIRCUIT AND DRIVING METHOD, ARRAY SUBSTRATE, AND DISPLAY DEVICE

CROSS-REFERENCE TO RELATED APPLICATIONS

The present application claims priority to Chinese Patent Application No. 201811132950.4 and filed Sep. 27, 2018, the entire contents of which are incorporated herein by reference.

TECHNICAL FIELD

The present disclosure relates to the field of display technology, and more particularly to a gate driving circuit and a driving method, an array substrate and a display device.

BACKGROUND

At present, the most commonly used liquid crystal display is a Thin Film Transistor (TFT) liquid crystal display. The TFT liquid crystal display uses a source driver to supply a driving voltage corresponding to a screen to be displayed to a data line to drive a display panel to display the image.

In the related art, a display stage of the liquid crystal display generally includes a heavy-load screen stage and a normal screen stage. In the heavy-load screen stage, the refresh rate of the liquid crystal display is high, and thus the load of the source driver is large, causing the temperature of the source driver to be excessively high.

It should be noted that the information disclosed in the Background section above is only for enhancement of understanding of the background of the present disclosure, and thus may include information that does not constitute prior art known to those of ordinary skill in the art.

SUMMARY

According to an aspect of the present disclosure, a gate driving circuit is provided. The gate driving circuit includes 4n stages of shift register units, and n stages of inversion units. One of the inversion units is disposed between every two groups of four adjacent stages of shift register units. A (n+1)th stage of the inversion units is disposed between two of the shift register units, and configured to, in response to a control signal, output in inverted phases gate driving signals outputted by the two shift register units in a heavy-load screen stage, and output in positive phases gate driving signals outputted by the two shift register units in a normal screen stage. The two of the shift register units are the (4n+1)th stage of the shift register units and the (4n+2)th stage of the shift register units, the (4n+2)th stage of the shift register units and the (4n+3)th stage of the shift register units, the (4n+3)th stage of the shift register units and the (4n+4)th stage of the shift register units, or the (4n+1)th stage of the shift register units and the (4n+4)th stage of the shift register units. n is greater than or equal to 0.

In an exemplary arrangement of the present disclosure, every four adjacent stages of the shift register units are provided with two of the inversion units. Each of the inversion units is disposed between every two of the shift register units.

In an exemplary arrangement of the present disclosure, the inversion unit is disposed between every adjacent two of the shift register units. The (n+1)th stage of the inversion unit is configured to, in response to a control signal, output in inverted phases or positive phases the gate driving signals outputted by the (2n+1)th stage of the shift register units and the (2n+2)th stage of the shift register units.

In an exemplary arrangement of the present disclosure, the inversion unit includes a positive-phase output circuit, an inverted-phase output circuit and a signal input circuit. The positive-phase output circuit is connected to an output end of the (2n+1)th stage of shift register unit, an output end of the (2n+2)th stage of shift register unit, a gate-driving-signal input end of the (2n+1)th row of pixel units, and a gate driving signal input end of the (2n+2)th row of pixel units. The positive-phase output circuit is configured to, in response to the control signal, transmit a gate driving signal outputted from the output end of the (2n+1)th stage of shift register unit to the gate-driving-signal input end of the (2n+1)th row of pixel units, and transmit a gate driving signal outputted from the output end of the (2n+2)th stage of shift register unit to the gate-driving-signal input end of the (2n+2)th row of pixel units. The inverted-phase output circuit is connected to an output end of the (2n+1)th stage of shift register unit, an output end of the (2n+2)th stage of shift register unit, a gate-driving-signal input end of the (2n+1)th row of pixel units, and a gate driving signal input end of the (2n+2)th row of pixel units, and configured to, in response to a signal of a first node, transmit a gate driving signal outputted from the output end of the (2n+1)th stage of shift register unit to the gate-driving-signal input end of the (2n+2)th row of pixel units, and transmit a gate driving signal outputted from the output end of the (2n+2)th stage of shift register unit to the gate-driving-signal input end of the (2n+1)th row of pixel units. The signal input circuit is connected to a first signal end and a second signal end, and configured to transmit the signal of the first signal end to the first node, in response to the signal of the first signal end, and transmit a signal of the second signal end to the first node in response to the control signal.

In an exemplary arrangement of the present disclosure, the normal phase output circuit includes a first transistor and a second transistor. The first transistor has a first end connected to the output end of the (2n+1)th stage of shift register unit, a second end connected to the gate-driving-signal input end of the (2n+1)th row of pixel units and a control end for receiving the control signal; and the second transistor has a first end connected to the output end of the (2n+2)th stage of shift register unit, a second end connected to the gate-driving-signal input end of the (2n+2)th row of pixel units and a control end for receiving the control signal.

In an exemplary arrangement of the present disclosure, the inverted-phase output circuit includes a third transistor and a fourth transistor. The third transistor has a first end connected to the output end of the (2n+2)th stage of shift register unit, a second end connected to the gate-driving-signal input end of the (2n+1)th row of pixel units, and a control end for receiving a signal from the first node. The fourth transistor has a first end connected to the output end of the (2n+1)th stage of shift register unit, a second end connected to the gate-driving-signal input end of the (2n+2)th row of pixel units, and a control end for receiving a signal from the first node.

In an exemplary arrangement of the present disclosure, the signal input circuit includes a fifth transistor and a sixth transistor. The fifth transistor has a first end connected to the first signal end, a control end connected to the first signal end, and a second end forming the first node. A sixth transistor has a first end connected to the first node, a second end connected to the second signal end, and a control end for receiving the control signal.

In an exemplary arrangement of the present disclosure, when the gate driving signal outputted from the shift register unit has no pre-charge time period, a plurality of the inversion units shares the same control signal.

In an exemplary arrangement of the present disclosure, the gate driving circuit is a 2M clock signal driving circuit, the gate driving signal outputted from the shift register unit has a pre-charge time period, and the N-th stage of inversion unit and the (N+M)th stage of inversion unit share the same control signal, where N and M each is greater than or equal to 1.

According to an aspect of the present disclosure, a driving method of a gate driving circuit is provided. The method includes, in a heavy-load screen stage, outputting gate driving signals outputted by two shift register units in inverted phases. The method includes in a normal screen stage, outputting gate driving signals outputted by the two shift register units in positive phases. The two of the shift register units are the (4n+1)th stage of the shift register units and the (4n+2)th stage of the shift register units, the (4n+2)th stage of the shift register units and the (4n+3)th stage of the shift register units, the (4n+3)th stage of the shift register units and the (4n+4)th stage of the shift register units, or the (4n+1)th stage of the shift register units and the (4n+4)th stage of the shift register units. n is greater than or equal to 0. In a normal screen stage, a pulse time period of a source driving signal is equal to a pulse time period of a gate driving signal.

In a heavy-load screen phase, the source driving signal has a pulse time period twice of that in the normal screen stage.

According to an aspect of the present disclosure, there is provided an array substrate including the gate driving circuit described above.

According to an aspect of the present disclosure, there is provided a display device including the array substrate described above.

The present exemplary arrangement provides a gate driving circuit and a driving method, an array substrate and a display device. One inversion unit is disposed between every two groups of four adjacent stages of shift register units in the gate driving circuit, and the inversion unit is configured to output in inverted phases, gate driving signals outputted by the two shift register units in a reloaded screen stage, and output in positive phases, gate driving signals outputted by the two shift register units in a normal screen stage.

It should be understood that both the foregoing general description and the following detailed description are exemplary and explanatory only and are not restrictive of the disclosure.

BRIEF DESCRIPTION OF THE DRAWINGS

The accompanying drawings, which are incorporated in and constitute a part of this specification, illustrate arrangements consistent with the disclosure and, together with the description, serve to explain the principles of the disclosure. Apparently, the drawings in the following description are only some of the arrangements of the present disclosure, and other drawings may be obtained from these drawings by those skilled in the art without paying creative effort.

DETAILED DESCRIPTION

Figure 1:
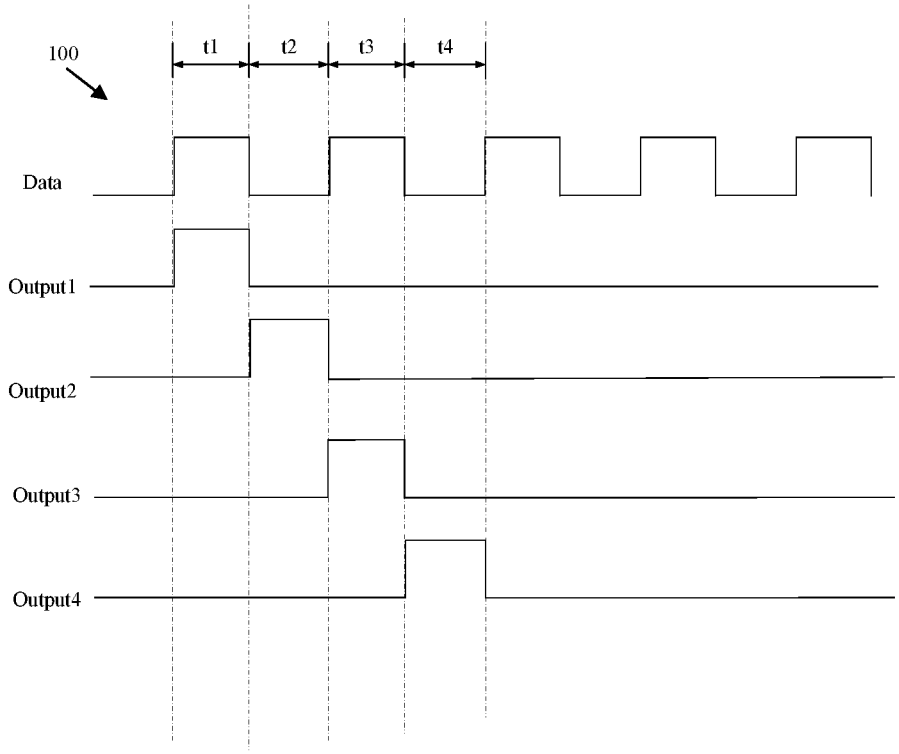
FIG. 1 (Related art)
FIG. 1 is a timing diagram of a source driving signal and an output signal of a shift register unit in a normal screen stage of a display method in the related art.

Exemplary arrangements will now be described more fully with reference to the accompanying drawings. However, the exemplary arrangements can be embodied in a variety of forms and should not be construed as being limited to the examples set forth herein. Rather, these arrangements are provided to make the present disclosure more comprehensive and complete, and to fully convey the concept of the exemplary arrangements to those skilled in the art. The same reference numerals in the drawings denote the same or similar structures, and thus detailed description thereof will be omitted.

Although the relative terms such as "on" and "under" are used in the specification to describe the relative relationship of one component to another component as illustrated, these terms are used in this specification for convenience only, for example, according to the direction of the example illustrated in the accompanying drawings. It will be understood that if the device as illustrated is flipped upside down, the component described as "on" will become the component "under". Other relative terms, such as "high", "low", "top", "bottom", "left", "right", etc., also have similar meanings.

When a structure is "on" another structure, it may mean that a structure is integrally formed on another structure, or that a structure is "directly" disposed on another structure, or that a structure is "indirectly" disposed on another structure via other structures.

The terms "a", "an", and "the" are used to mean the presence of one or more elements/components, etc. The terms "including" and "having" are used to have a non-exclusive meaning of including, and mean that other elements/components/etc. may be present in addition to the listed elements/components/etc.

The present exemplary arrangement first provides a gate driving circuit including 4n stages of shift register units and n stages of inversion units. One of the inversion units is disposed between every two groups of four adjacent stages of shift register units. A (n+1)th stage of the inversion units is disposed between two of the shift register units, and configured to, in response to a control signal, output in inverted phases gate driving signals outputted by the two shift register units in a heavy-load screen stage, and output in positive phases gate driving signals outputted by the two shift register units in a normal screen stage. The two of the shift register units are respectively the (4n+1)th stage of the shift register units and the (4n+2)th stage of the shift register units, or the (4n+2)th stage of the shift register units and the (4n+3)th stage of the shift register units, or the (4n+3)th stage of the shift register units and the (4n+4)th stage of the shift register units, or the (4n+1)th stage of the shift register units and the (4n+4)th stage of the shift register units, where n is greater than or equal to 0.

Figure 2:
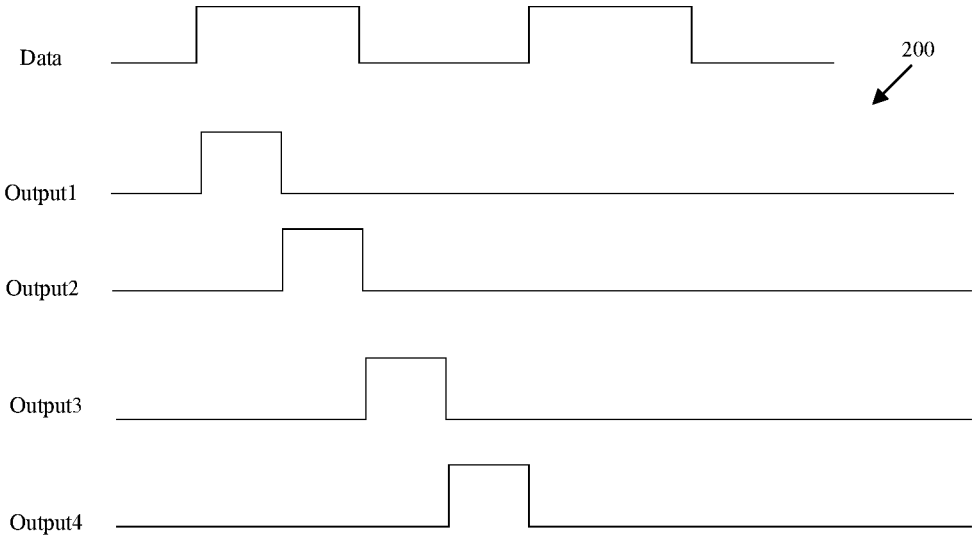
FIG. 2 (Related art)
FIG. 2 is a timing diagram of a source driving signal and an output signal of a shift register unit in a heavy-load screen stage of a display method in the related art.
Figure 3:
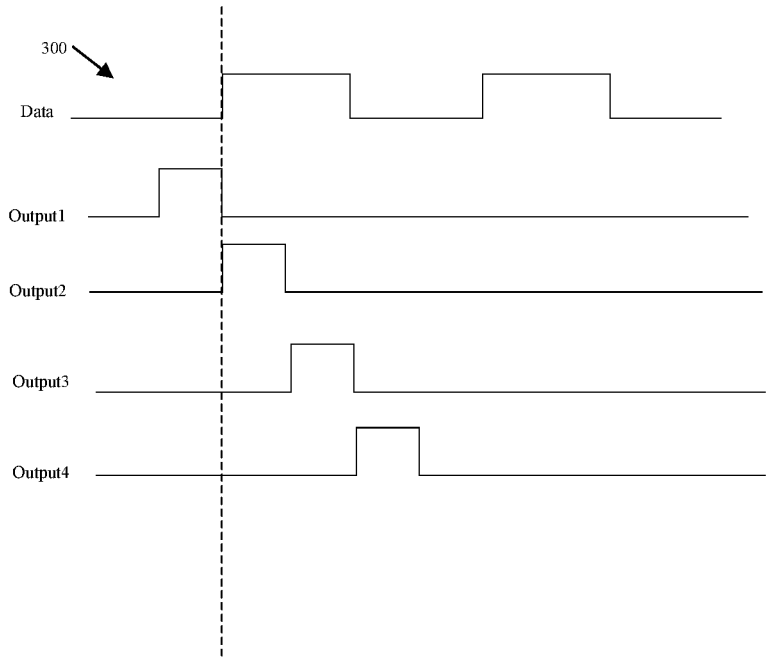
FIG. 3 (Related art)
FIG. 3 is another timing diagram of a source driving signal and an output signal of a shift register unit in a heavy-load screen stage of a display method in the related art.
Figure 4:
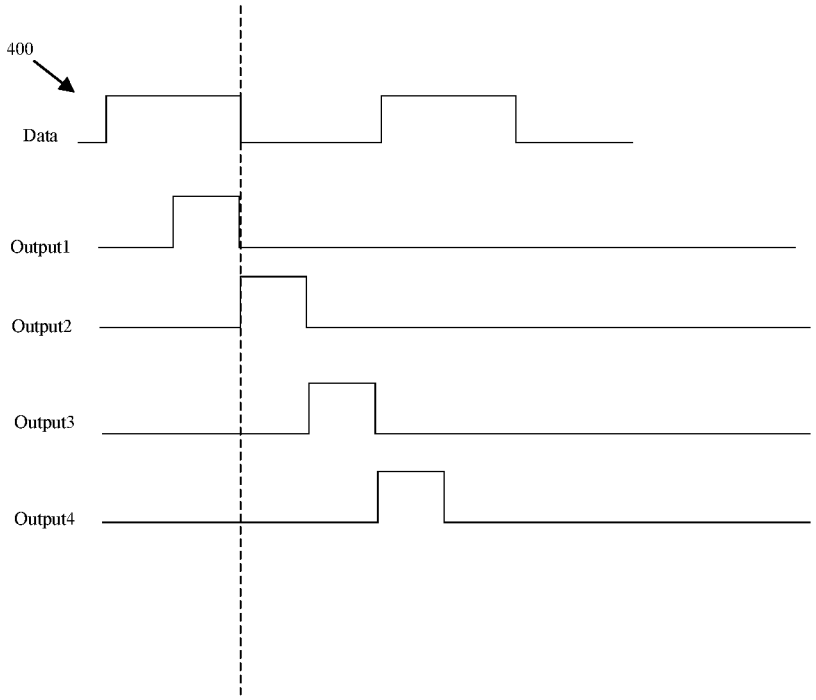
FIG. 4 (Related art)
FIG. 4 is another timing diagram of a source driving signal and an output signal of a shift register unit in a heavy-load screen stage of a display method in the related art.
Figure 5:
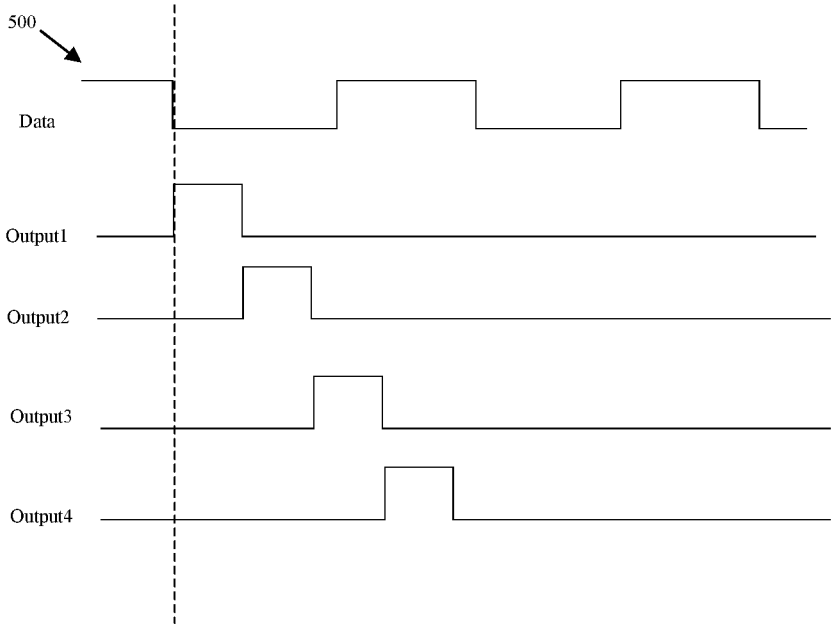
FIG. 5 (Related art)
FIG. 5 is another timing diagram of a source driving signal and an output signal of a shift register unit in a heavy-load screen stage of a display method in the related art.

The gate driving circuit provided by the exemplary arrangement is suitable for a display method, in which a frequency of polarity change of the source driving signal can be reduced to one-half of the original frequency in a heavy-load screen stage, while can ensure proper display of pixels by outputting in an inverted phase a gate driving signal outputted by a shift register unit. As shown in FIG. 1, a timing diagram 100 of a source driving signal and an output signal of a shift register unit in a normal screen stage of a display method is shown. In a normal display stage, a source driving signal Data has a pulse time period equal to a pulse time period of an output signal output of the shift register unit. In a time period t1, in the gate driving circuit, the output signal output1 of a (4n+1)th stage of shift register unit is at a high level, and the source driving signal Data inputs a high level to a (4n+1)th row of pixel units. In a time period t2, in the gate driving circuit, the output signal output2 of a (4n+2)th stage of shift register unit is at a high level, and Data inputs a high level to a (4n+2)th row of pixel units. In a time period t3, in the gate driving circuit, the output signal output3 of a (4n+3)th stage of shift register unit is at a high level, and Data inputs a high level to a (4n+3)th row of pixel units. In a time period t4, in the gate driving circuit, the output signal output4 of a (4n+4)th stage of shift register unit is at a high level, and Data inputs a high level to a (4n+4)th row of pixel units. The display method may perform line inversion or point inversion display method in a normal screen stage. As shown in FIG. 2, a timing diagram 200 of a source driving signal and an output signal of a shift register unit in a heavy-load screen stage of a display method is shown. In a heavy-load screen stage, a signal output outputted by the shift register unit is unchanged for one pulse time period, and a frequency of the polarity change of the source driving signal is reduced to one-half of the original frequency. That is, one pulse time period of the source driving signal Data becomes twice as long as the original. In the display method, signals outputted by the (4n+2)th row and the (4th+3)th row of shift register units are inverted simultaneously. That is, the gate driving signal outputted by the (4n+2)th stage of shift register unit is transmitted to the (4th+3)th row of pixel units, and at the same time, the gate driving signal outputted by the (4n+3)th stage of shift register unit is transmitted to the (4th+2)th row of pixel units, to implement the above line inversion or point inversion display manner. In addition, as shown in FIG. 2, by outputting in an inverted phase the (4n+1)th stage of shift register unit and the (4n+4)th stage of shift register unit, it can also implement the above line inversion or point inversion display manner, where n is greater than 0. It should be noted that the timing relationship between the source driving signal Data and the gate driving signal outputted by the (4n+1)th stage of shift register may affect the sequence number of stages of the two shift register units that are required to be outputted in an inverting phase. As shown in FIGS. 3, 4 and 5, FIG. 3 is another timing diagram 300 of a source driving signal and an output signal of a shift register unit in a heavy-load screen stage of a display method in the related art; FIG. 4 is another timing diagram 400 of a source driving signal and an output signal of a shift register unit in a heavy-load screen stage of a display method in the related art; and FIG. 5 is another timing diagram 500 of a source driving signal and an output signal of a shift register unit in a heavy-load screen stage of a display method in the related art. In FIG. 3, the rising edge of the source driving signal is aligned with the falling edge of the gate driving signal outputted by the (4n+1)th row of shift register. In FIG. 4, the falling edge of the source driving signal is aligned with the falling edge of the gate driving signal outputted by the (4n+1)th row of shift register. In FIG. 5, the falling edge of the source driving signal is aligned with the rising edge of the gate driving signal outputted by the (4n+1)th row of shift register. As can be seen from FIGS. 3, 4, and 5, by outputting in an inverted phase the signals outputted by (4n+1)th stage of shift register unit and the (4n+2)th stage of shift register unit, or by outputting in an inverted phase the signals outputted by (4n+3)th stage of shift register unit and the (4n+4)th stage of shift register unit, as shown in FIGS. 3 and 4, the above mentioned line inversion or point inversion display manner may be implemented.

The present exemplary arrangement provides a gate driving circuit. One inversion unit is disposed between every two groups of four adjacent stages of shift register units in the gate driving circuit, and the inversion unit is configured to output in inverted phases, gate driving signals outputted by the two shift register units in a heavy-load screen stage, and output in positive phases, gate driving signals outputted by the two shift register units in a normal screen stage. On the one hand, in the present disclosure, by outputting in an inverted phase the gate driving signals outputted by the two shift register units in the heavy-load screen stage, it can realize reduction of load of the source driver by reducing the change frequency of the source driving signal. On the other hand, in the present disclosure, it can realize switching between outputting in an inverted phase and outputting in a positive phase through an inversion unit, and realize switching between a heavy-load screen and a normal screen.

In the exemplary arrangement, one inversion unit is provided for every four adjacent stages of shift register units, and the inversion unit is disposed between two shift register units of the four shift register units, and the remaining two shift register units are directly connected to corresponding pixel units. Such arrangement makes the signals outputted by the shift registers connected to the inversion unit have different output path from that of the signals outputted by the shift registers not connected to the inversion unit. In this way, the strengths of the gate driving signals may be changed, and the timing sequence may be disordered. In the exemplary arrangement, the gate driving circuit may include 2n stages of inversion units; every four adjacent stages of shift register units are provided with two of the inversion units. The inversion unit is disposed between two of the shift register units. In every four adjacent shift register units, one inversion unit is disposed between two shift register units according to the above connection manner, and the other inversion unit is disposed between the other two shift register units. Such arrangement can make the gate driving signals outputted by each stage of the shift register units to have the same output path.

In the exemplary arrangement, the inversion unit may be formed on an array substrate by a patterning process. The inversion unit is disposed between the first stage of shift register unit and the fourth stage of shift register unit in the same group, which may improve the difficulty of the patterning process. In the exemplary arrangement, the inversion unit is preferably disposed between every adjacent two of the shift register units; the (n+1)th stage of inversion unit is configured to, in response to a control signal, output, in inverted phases or positive phases, the gate driving signals outputted by the (2n+1)th stage of the shift register units and the (2n+2)th stage of the shift register units, where n is greater than 0. That is, an inversion unit is disposed between the (4n+1)th stage of shift register and the (4n+2)th stage of shift register, and an inversion unit is disposed between the (4n+3)th stage of shift register and the (4n+4)th stage of shift register.

Figure 6:
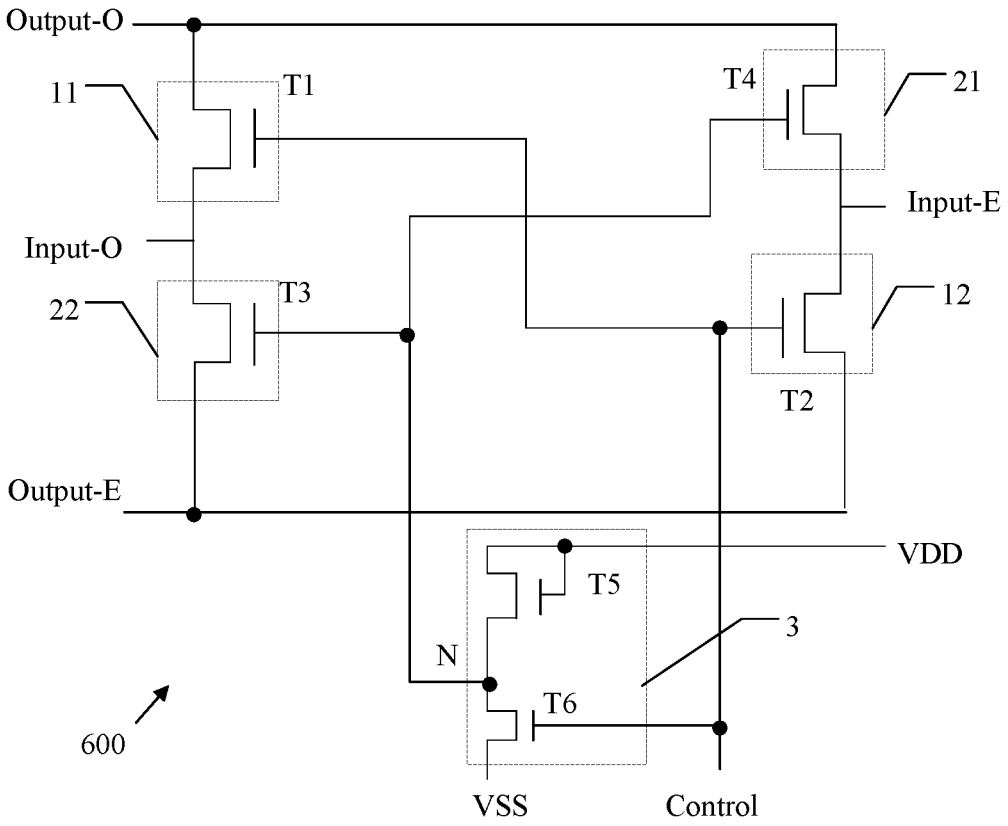
FIG. 6 is a schematic structural diagram of an inversion unit in an exemplary arrangement of a gate driving circuit according to the present disclosure.

In an exemplary arrangement, as shown in FIG. 6, an exemplary schematic structural diagram 600 of an inversion unit of a gate driving circuit is shown, according to the present disclosure. The inversion unit may include a positive-phase output circuit, an inverted-phase output circuit, and a signal input circuit 3. The positive-phase output circuit may include a first positive-phase output sub-circuit 11 and a second positive-phase output sub-circuit 12. The first positive-phase output sub-circuit 11 is connected to an output end output-O of the (2n+1)th stage of shift register unit and a gate-driving-signal input end input-O of the (2n+1)th row of pixel units, and configured to, in response to the control signal, transmit the gate driving signal outputted from the output end output-O of the (2n+1)th stage of shift register unit to the gate-driving-signal input end input-O of the (2n+1)th row of pixel units. The second positive-phase output sub-circuit 12 is connected to an output end output-E of the (2n+2)th stage of shift register unit and a gate-driving-signal input end input-E of the (2n+2)th row of pixel units, and configured to, in response to the control signal, transmit the gate driving signal outputted from the output end output-E of the (2n+2)th stage of shift register unit to the gate-driving-signal input end input-E of the (2n+2)th row of pixel units. The inverted-phase output circuit may include a first inverted-phase output sub-circuit 21 and a second inverted-phase output sub-circuit 22. The first inverted-phase output sub-circuit 21 may be connected to the output end output-O of the (2n+1)th stage of shift register unit and the gate-driving-signal input end input-E of the (2n+2)th row of pixel units, and configured to, in response to a signal of a first node N, transmit the gate driving signal outputted from the output end output-O of the (2n+1)th stage of shift register unit to the gate-driving-signal input end input-E of the (2n+2)th row of pixel units. The second inverted-phase output sub-circuit 22 may be connected to the output end output-O of the (2n+1)th stage of shift register unit and the gate-driving-signal input end input-E of the (2n+2)th row of pixel units, and configured to, in response to a signal of a first node N, transmit the gate driving signal outputted from the output end output-E of the (2n+2)th stage of shift register unit to the gate-driving-signal input end input-O of the (2n+1)th row of pixel units. The signal input circuit is connected to a first signal end VDD and a second signal end VSS, and configured to transmit a signal of the first signal end VDD to the first node N in response to the signal of the first signal end VDD, and transmit a signal of the second signal end VS S to the first node N in response to the control signal. The first signal end VDD is at a high level, and the second signal end VSS is at a low level.

In the present exemplary arrangement, as shown in FIG. 6, the first positive-phase output sub-circuit 11 may include a first transistor T1, and the second positive-phase output sub-circuit 12 may include a second transistor T2. The first transistor T1 has a first end connected to the output end output-O of the (2n+1)th stage of shift register unit, a second end connected to the gate-driving-signal input end input-O of the (2n+1)th row of pixel units and a control end for receiving the control signal. The second transistor T2 has a first end connected to the output end output-E of the (2n+2)th stage of shift register unit, a second end connected to the gate-driving-signal input end input-E of the (2n+2)th row of pixel units and a control end for receiving the control signal. When the control signal is at a high level, the first transistor T1 and the second transistor T2 are turned on; the signal outputted from the output end output-O of the (2n+1)th stage of shift register unit is transmitted to the gate-driving-signal input end input-O of the (2n+1)th row of pixel units through the first transistor T1; and the signal outputted from the output end output-E of the (2n+2)th stage of shift register unit is transmitted to the gate-driving-signal input end input-E of the (2n+2)th row of pixel units through the first transistor T2.

In an exemplary arrangement, the first inverted-phase output sub-circuit 21 may include a fourth transistor T4, and the second inverted-phase output sub-circuit 22 may include a third transistor T3. The third transistor T3 has a first end connected to the output end output-E of the (2n+2)th stage of shift register unit, a second end connected to the gate-driving-signal input end input-O of the (2n+1)th row of pixel units, and a control end for receiving a signal from the first node N. The fourth transistor T4 has a first end connected to the output end output-O of the (2n+1)th stage of shift register unit, a second end connected to the gate-driving-signal input end input-E of the (2n+2)th row of pixel units, and a control end for receiving a signal from the first node N. When the signal of the first node N is at a high level, the third transistor T3 and the fourth transistor T4 are turned on; the gate driving signal outputted from the output end output-O of the (2n+1)th stage of shift register unit is transmitted to the gate-driving-signal input end input-E of the (2n+2)th row of pixel units; and the gate driving signal outputted from the output end output-E of the (2n+2)th stage of shift register unit is transmitted to the gate-driving-signal input end input-O of the (2n+1)th row of pixel units.

In the present exemplary arrangement, the signal input circuit 3 may include a fifth transistor T5 and a sixth transistor T6. The fifth transistor T5 has a first end connected to the first signal end VDD, a control end connected to the first signal end, and a second end forming the first node. The sixth transistor T6 has a first end connected to the first node, a second end connected to the second signal end VSS, and a control end for receiving the control signal. When the control signal is at a high level, the first transistor T1 and the second transistor T2 are turned on. At the same time, the sixth transistor T6 is turned on, and the signal VSS of the second signal terminal is transmitted to the first node N. The third transistor T3 and the fourth transistors T4 are turned off. At this time, the first transistor T1 and the second transistor T2 are turned on; the signal outputted from the output end output-O of the (2n+1)th stage of shift register unit is transmitted to the gate-driving-signal input end input-O of the (2n+1)th row of pixel units through the first transistor T1; and the signal outputted from the output end output-E of the (2n+2)th stage of shift register unit is transmitted to the gate-driving-signal input end input-E of the (2n+2)th row of pixel units through the second transistor T2. When the control signal is at a low level, the first transistor T1, the second transistor T2, and the sixth transistor T6 are turned off, the fifth transistor is turned on under the action of VDD, and the signal of the first signal end VDD is transmitted to the first node N. The third transistors T3 and the fourth transistor T4 are turned on; the signal outputted by the output end output-O of the (2n+1)th stage of shift register unit is transmitted to the gate-driving-signal input end input-E of the (2n+2)th row of pixel units through the fourth transistor T4; and the signal outputted by the output end output-E of the (2n+2)th stage of shift register unit is transmitted to the gate-driving-signal input end input-O of the (2n+1)th row of pixel units through the fourth transistor T3.

Figure 7:
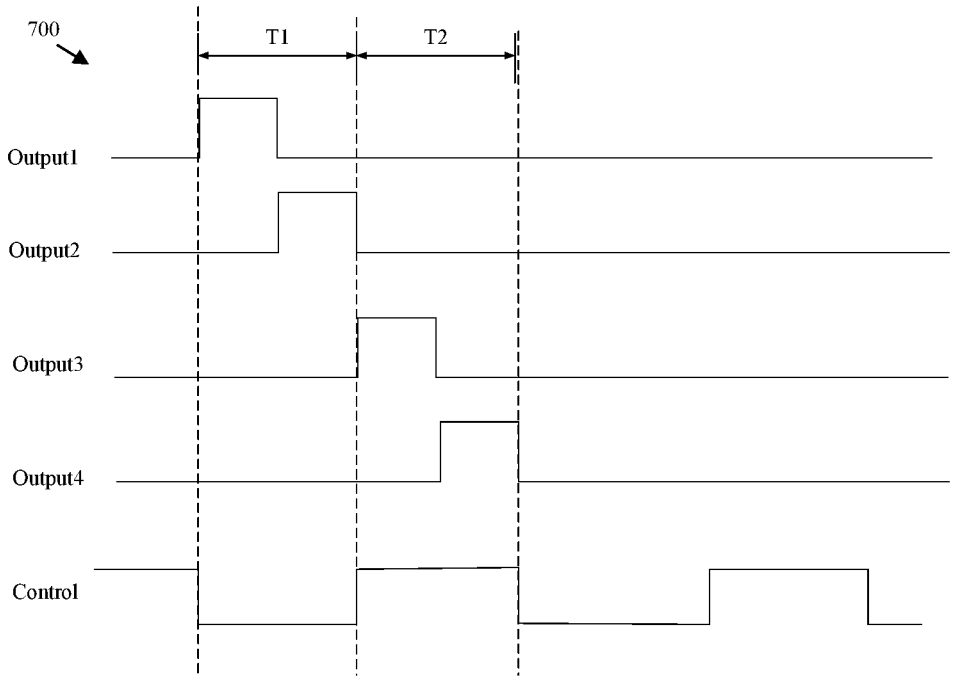
FIG. 7 is a timing diagram of an output signal of a gate driving circuit and a control signal in an exemplary arrangement of the gate driving circuit according to the present disclosure.
Figure 8:
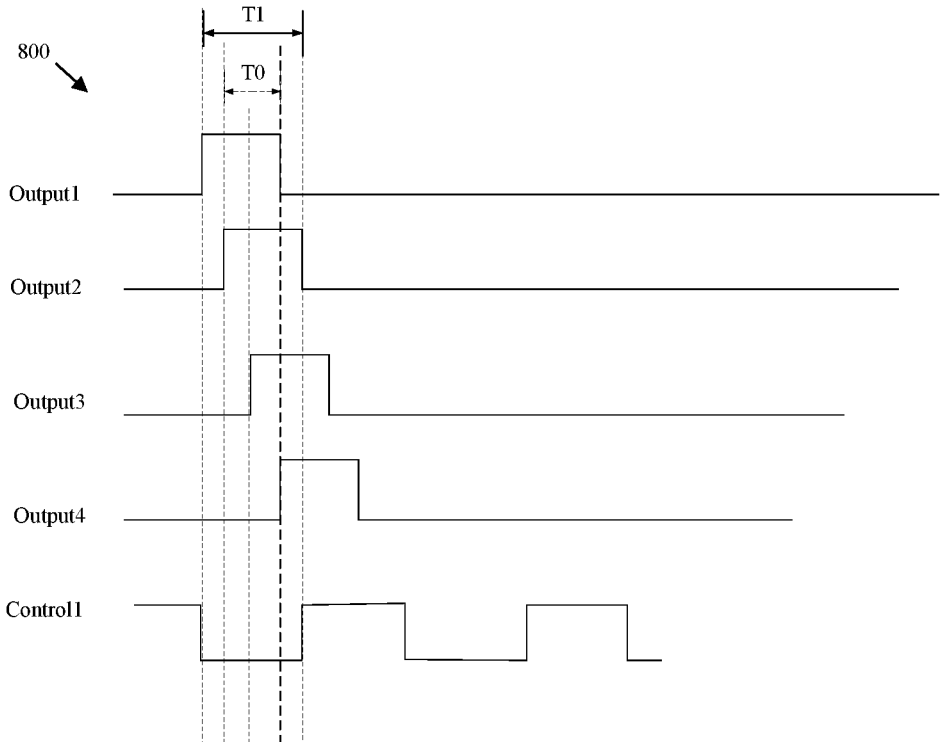
FIG. 8 is a timing diagram of an output signal of a gate driving circuit and a control signal in another exemplary arrangement of the gate driving circuit according to the present disclosure.
Figure 9:
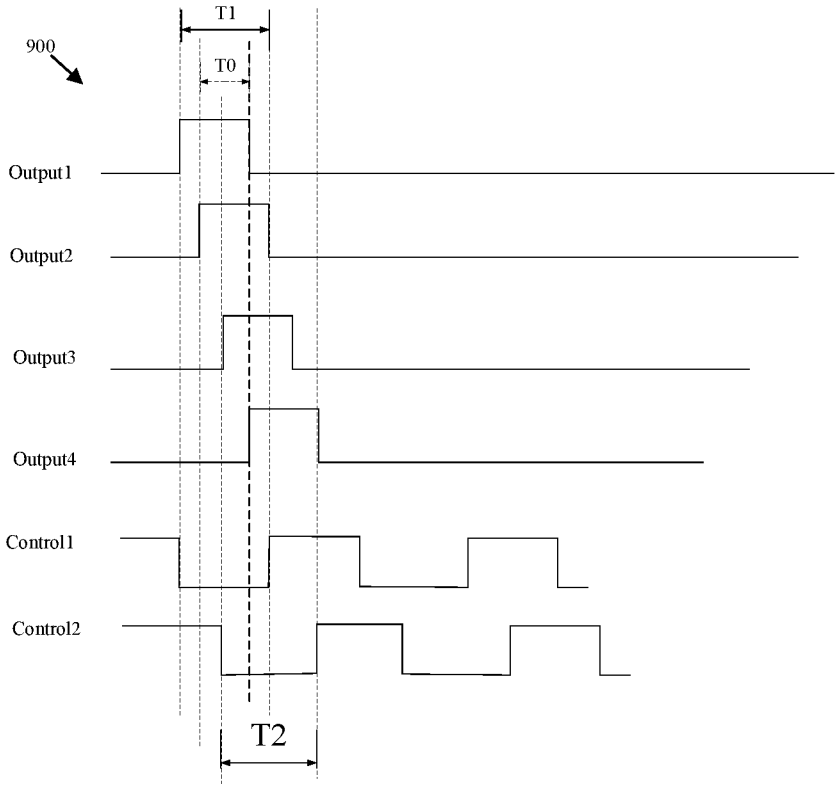
FIG. 9 is a timing diagram of an output signal of a gate driving circuit and a control signal in another exemplary arrangement of the gate driving circuit according to the present disclosure.
Figure 10:
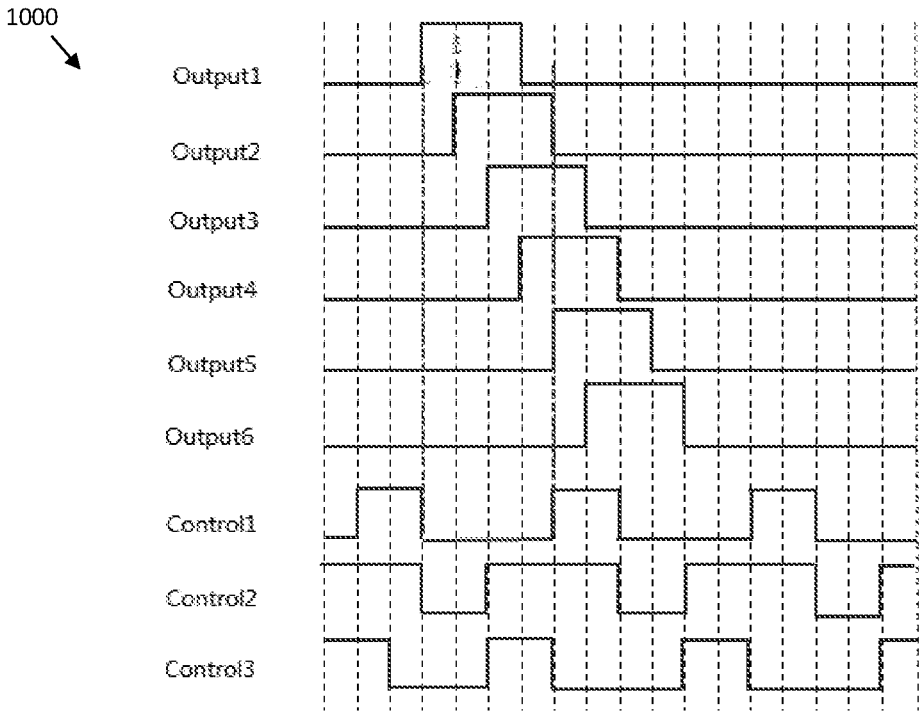
FIG. 10 is a timing diagram of an output signal of a gate driving circuit and a control signal in another exemplary arrangement of the gate driving circuit according to the present disclosure.
Figure 11:
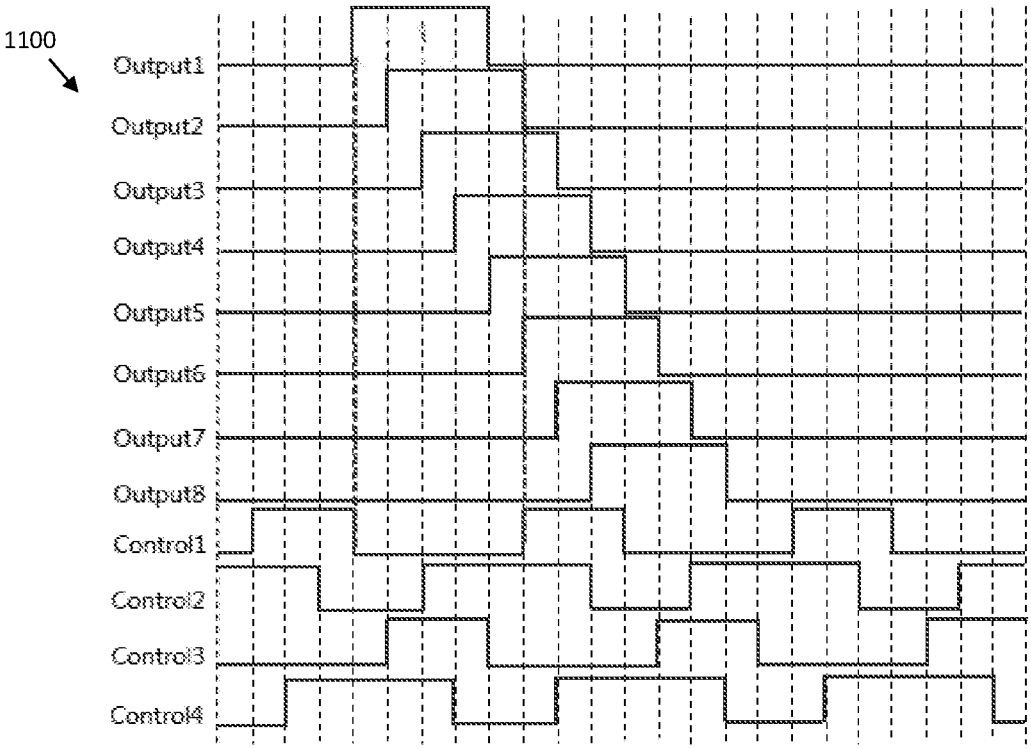
FIG. 11 is a timing diagram of an output signal of a gate driving circuit and a control signal in another exemplary arrangement of the gate driving circuit according to the present disclosure.

In an exemplary arrangement, a plurality of the inversion units may share the same control signal. As shown in FIG. 7, a timing diagram 700 of an output signal of a gate driving circuit and a control signal of the gate driving circuit is shown, according to the present disclosure. In the T1 time period, the control signal Control is at a low level, the signals outputted by the (2n+1)th stage of shift register unit and the (2n+2)th stage of shift register unit are outputted in inverted phases; and in the T2 time period, the signals outputted by the (2n+3)th stage of shift register unit and the (2n+4)th stage of shift register unit are outputted in positive phases In the present exemplary arrangement, as shown in FIG. 8, a timing diagram 800 of an output signal of a gate driving circuit and a control signal of the gate driving circuit is shown, according to the present disclosure. In this arrangement, the gate driving signal outputted from the shift register unit has a pre-charge time period T0. Apparently, if all the shift register units still share a control signal Control, in the T1 time period, not only the signals outputted by the (2n+1)th stage of shift register unit and the (2n+2)th stage of shift register unit are outputted in inverted phases; but also at the same time, the signals outputted by the (2n+3)th stage of shift register unit and the (2n+4)th stage of shift register unit are also outputted in inverted phases. Therefore, as shown in FIG. 9, a timing diagram 900 of an output signal of a gate driving circuit and a control signal of the gate driving circuit is shown, according to the present disclosure. This arrangement will be described by taking a gate driving circuit as a four clock signal driving circuit as an example. When the gate driving signal outputted from the shift register unit has a pre-charge time period, the inversion unit may be controlled through two control signals. In the T1 time period, the inversion unit is controlled through a first control signal Control1 to output in an inverted phase the signal outputted by the (2n+1)th stage of shift register unit and the (2n+2)th stage of shift register unit; and in the T2 time period, the inversion unit is controlled through a second control signal Control2 to output in an inverted phase the signal outputted by the (2n+3)th stage of shift register unit and the (2n+4)th stage of shift register unit. In the present exemplary arrangement, the n-th stage of inversion unit and the (n+2)th stage of inversion unit may share the same control signal. Similarly, when the gate driving circuit is a 2M clock signal driving circuit, the N-th stage of inversion unit and the (N+M)th stage of inversion unit can share the same control signal, and the gate driving circuit needs M control signals, where N, M is greater than or equal to 1. For example, as shown in FIG. 10, a timing diagram 1000 of an output signal of a gate driving circuit and a control signal of the gate driving circuit is shown, according to the present disclosure. The gate driving circuit is a six clock signal driving circuit that requires three control signals Control1, Control2, and Control3. As shown in FIG. 11, a timing diagram 1100 of an output signal of a gate driving circuit and a control signal of the gate driving circuit is shown, according to the present disclosure. The gate driving circuit is an eight clock signal driving circuit that requires four control signals Control1, Control2, Control3 and Control4.

Figure 12:
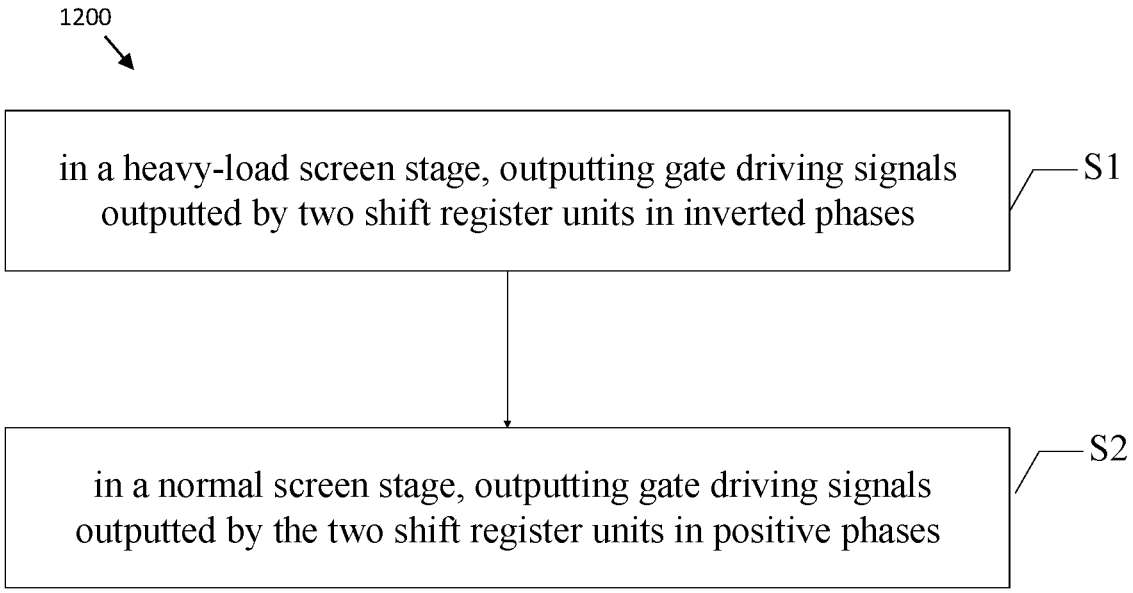
FIG. 12 is a flow chart of a driving method of a gate driving circuit according to the present disclosure.

An exemplary arrangement further provides a driving method of the gate driving circuit, as shown in FIG. 12, is a flow chart of a driving method 1200 of a gate driving circuit according to the present disclosure, the method includes the following blocks.

In block S1, in a heavy-load screen stage, gate driving signals outputted by the two shift register units are outputted in inverted phases.

In block S2, in a normal screen stage, gate driving signals outputted by the two shift register units are outputted in positive phases.

The two shift register units are the (4n+1)th stage of shift register unit and the (4n+2)th stage of shift register unit, or the (4n+2)th stage of shift register unit and the (4n+3)th stage of shift register unit, or the (4n+3)th stage of shift register unit and the (4n+4)th stage of shift register unit, or the (4n+1)th stage of shift register unit and (4n+4)th stage of shift register unit, where n is greater than or equal to 0.

The driving method of the gate driving circuit provided by the exemplary arrangement has the same technical features and working principles as the above-described gate driving circuit, details of which will not be repeated herein.

An exemplary arrangement also provides an array substrate including the gate driving circuit described above.

The array substrate provided by the exemplary arrangement has the same technical features and working principles as the above-mentioned gate driving circuit, details of which will not be repeated herein.

The present exemplary arrangement also provides a display device including the above array substrate.

The display device provided by the exemplary arrangement has the same technical features and working principles as the above array substrate, details of which will not be repeated herein. Other arrangements of the disclosure will be apparent to those skilled in the art from consideration of the specification and practice of the disclosure disclosed here. This application is intended to cover any variations, uses, or adaptations of the disclosure following the general principles thereof and including such departures from the present disclosure as come within known or customary practice in the art. It is intended that the specification and arrangements be considered as exemplary only, with a true scope and spirit of the disclosure being indicated by the following claims.

The features, structures, or characteristics described above may be combined in any suitable manner in one or more arrangements, and the features discussed in the various arrangements are interchangeable, if possible. In the above description, numerous specific details are set forth to provide a thorough understanding of the arrangements of the present disclosure. However, one skilled in the art will appreciate that the technical solution of the present disclosure may be practiced without one or more of the specific details, or other methods, components, materials, and the like may be employed. In other instances, well-known structures, materials or operations are not shown or described in detail to avoid obscuring aspects of the present disclosure.

What is claimed is:

1. A gate driving circuit, comprising:

4n stages of shift register units; and n stages of inversion units, wherein n is an integer greater than 0 and each of the inversion units comprises:

a positive-phase output circuit connected to an output end of a (2n+1)th stage of the shift register units, an output end of a (2n+2)th stage of the shift register units, a gate-driving-signal input end of a (2n+1)th row of pixel units, and a gate driving signal input end of a (2n+2)th row of pixel units, and configured to, in response to the control signal, transmit a gate driving signal outputted from the output end of the (2n+1)th stage of the shift register units to the gate-driving-signal input end of the (2n+1)th row of pixel units, and transmit a gate driving signal outputted from the output end of the (2n+2)th stage of the shift register units to the gate-driving-signal input end of the (2n+2)th row of pixel units;

an inverted-phase output circuit connected to an output end of the (2n+1)th stage of the shift register units, an output end of the (2n+2)th stage of the shift register units, a gate-driving-signal input end of the (2n+1)th row of pixel units, and a gate driving signal input end of the (2n+2)th row of pixel units, and configured to, in response to a signal of a first node, transmit a gate driving signal outputted from the output end of the (2n+1)th stage of the shift register units to the gate-driving-signal input end of the (2n+2)th row of pixel units, and transmit a gate driving signal outputted from the output end of the (2n+2)th stage of the shift register units to the gate-driving-signal input end of the (2n+1)th row of pixel units; and a signal input circuit connected to a first signal end and a second signal end, and configured to transmit the signal of the first signal end to the first node, in response to the signal of the first signal end, and transmit a signal of the second signal end to the first node in response to the control signal.

2. The gate driving circuit according to claim 1, wherein the positive-phase output circuit comprises:

a first transistor having a first end connected to the output end of the (2n+1)th stage of the shift register units, a second end connected to the gate-driving-signal input end of the (2n+1)th row of pixel units and a control end for receiving the control signal; and a second transistor having a first end connected to the output end of the (2n+2)th stage of the shift register units, a second end connected to the gate-driving-signal input end of the (2n+2)th row of pixel units and a control end for receiving the control signal.

3. The gate driving circuit according to claim 1, wherein the inverted-phase output circuit comprises:

a third transistor having a first end connected to the output end of the (2n+2)th stage of the shift register units, a second end connected to the gate-driving-signal input end of the (2n+1)th row of pixel units, and a control end for receiving a signal from the first node; and a fourth transistor having a first end connected to the output end of the (2n+1)th stage of the shift register units, a second end connected to the gate-driving-signal input end of the (2n+2)th row of pixel units, and a control end for receiving a signal from the first node.

4. The gate driving circuit of claim 1, wherein the signal input circuit comprises:

a fifth transistor having a first end connected to the first signal end, a control end connected to the first signal end, and a second end forming the first node; and a sixth transistor having a first end connected to the first node, a second end connected to the second signal end, and a control end for receiving the control signal.

5. The gate driving circuit according to claim 1, wherein the inversion units share the same control signal.

6. The gate driving circuit according to claim 1, wherein the gate driving circuit is a 2M clock signal driving circuit, the gate driving signal outputted from the shift register units has a pre-charge time period, and a n-th stage of the inversion units and a (n+M)th stage of the inversion units share the same control signal, where n and M each is greater than or equal to 1.

7. An array substrate, comprising:

a gate driving circuit, comprising:

4n stages of shift register units; and n stages of inversion units, wherein n is an integer greater than 0 and each of the inversion units comprises:

a positive-phase output circuit connected to an output end of a (2n+1)th stage of the shift register units, an output end of a (2n+2)th stage of the shift register units, a gate-driving-signal input end of a (2n+1)th row of pixel units, and a gate driving signal input end of a (2n+2)th row of pixel units, and configured to, in response to the control signal, transmit a gate driving signal outputted from the output end of the (2n+1)th stage of the shift register units to the gate-driving-signal input end of the (2n+1)th row of pixel units, and transmit a gate driving signal outputted from the output end of the (2n+2)th stage of the shift register units to the gate-driving-signal input end of the (2n+2) th row of pixel units;

an inverted-phase output circuit connected to an output end of the (2n+1)th stage of the shift register units, an output end of the (2n+2)th stage of the shift register units, a gate-driving-signal input end of the (2n+1)th row of pixel units, and a gate driving signal input end of the (2n+2)th row of pixel units, and configured to, in response to a signal of a first node, transmit a gate driving signal outputted from the output end of the (2n+1)th stage of the shift register units to the gate-driving-signal input end of the (2n+2)th row of pixel units, and transmit a gate driving signal outputted from the output end of the (2n+2)th stage of the shift register units to the gate-driving-signal input end of the (2n+1)th row of pixel units; and a signal input circuit connected to a first signal end and a second signal end, and configured to transmit the signal of the first signal end to the first node, in response to the signal of the first signal end, and transmit a signal of the second signal end to the first node in response to the control signal.

8. The array substrate according to claim 7, wherein the positive-phase output circuit comprises:

a first transistor having a first end connected to the output end of the (2n+1)th stage of the shift register units, a second end connected to the gate-driving-signal input end of the (2n+1)th row of pixel units and a control end for receiving the control signal; and a second transistor having a first end connected to the output end of the (2n+2)th stage of the shift register units, a second end connected to the gate-driving-signal input end of the (2n+2)th row of pixel units and a control end for receiving the control signal.

9. The array substrate according to claim 7, wherein the inverted-phase output circuit comprises:

a third transistor having a first end connected to the output end of the (2n+2)th stage of the shift register units, a second end connected to the gate-driving-signal input end of the (2n+1)th row of pixel units, and a control end for receiving a signal from the first node; and a fourth transistor having a first end connected to the output end of the (2n+1)th stage of the shift register units, a second end connected to the gate-driving-signal input end of the (2n+2)th row of pixel units, and a control end for receiving a signal from the first node.

10. The array substrate of claim 7, wherein the signal input circuit comprises:

a fifth transistor having a first end connected to the first signal end, a control end connected to the first signal end, and a second end forming the first node; and a sixth transistor having a first end connected to the first node, a second end connected to the second signal end, and a control end for receiving the control signal.

11. The array substrate according to claim 7, wherein the inversion units share the same control signal.

12. The array substrate according to claim 7, wherein the gate driving circuit is a 2M clock signal driving circuit, the gate driving signal outputted from the shift register units has a pre-charge time period, and a n-th stage of the inversion units and a (n+M)th stage of the inversion units share the same control signal, where n and M each is greater than or equal to 1.

13. A display device comprising an array substrate, the array substrate comprising a gate driving circuit that comprises:

4n stages of shift register units; and n stages of inversion units, wherein n is an integer greater than 0 and each of the inversion units comprises:

a positive-phase output circuit connected to an output end of a (2n+1)th stage of the shift register units, an output end of a (2n+2)th stage of the shift register units, a gate-driving-signal input end of a (2n+1)th row of pixel units, and a gate driving signal input end of a (2n+2)th row of pixel units, and configured to, in response to the control signal, transmit a gate driving signal outputted from the output end of the (2n+1)th stage of the shift register units to the gate-driving-signal input end of the (2n+1)th row of pixel units, and transmit a gate driving signal outputted from the output end of the (2n+2)th stage of the shift register units to the gate-driving-signal input end of the (2n+2)th row of pixel units;

an inverted-phase output circuit connected to an output end of the (2n+1)th stage of the shift register units, an output end of the (2n+2)th stage of the shift register units, a gate-driving-signal input end of the (2n+1)th row of pixel units, and a gate driving signal input end of the (2n+2)th row of pixel units, and configured to, in response to a signal of a first node, transmit a gate driving signal outputted from the output end of the (2n+1)th stage of the shift register units to the gate-driving-signal input end of the (2n+2)th row of pixel units, and transmit a gate driving signal outputted from the output end of the (2n+2)th stage of the shift register units to the gate-driving-signal input end of the (2n+1)th row of pixel units; and a signal input circuit connected to a first signal end and a second signal end, and configured to transmit the signal of the first signal end to the first node, in response to the signal of the first signal end, and transmit a signal of the second signal end to the first node in response to the control signal.

* * * * *